United States Patent [19]

Halbich

[11] 4,253,572

[45] Mar. 3, 1981

[54] PLASTIC PILLBOX

[76] Inventor: Frank Halbich, Van Nuys, Calif.

[21] Appl. No.: 34,471

[22] Filed: Apr. 30, 1979

[51] Int. Cl.[3] ..... B65D 83/04; B65D 85/56; B65D 1/24; B65D 1/36

[52] U.S. Cl. ..... 206/538; 206/601; 220/21; 220/306

[58] Field of Search ..... 206/538, 534, 601; 220/21, 306, 307; 53/392

[56] References Cited

U.S. PATENT DOCUMENTS

| | | | |
|---|---|---|---|
| 2,729,375 | 1/1956 | Pace | 220/21 |
| 2,880,262 | 3/1959 | Bell et al. | 220/307 |
| 3,084,695 | 4/1978 | Halbich | 206/601 |
| 3,450,252 | 6/1969 | Hallerbach | 206/534 |
| 3,842,974 | 10/1974 | Jacobsen | 220/306 |
| 3,934,733 | 1/1976 | Worden | 53/392 |

*Primary Examiner*—William T. Dixson, Jr.

*Attorney, Agent, or Firm*—Herzig & Walsh, Inc.

[57] ABSTRACT

A dispensing container or box for pills or capsules having multiple individual compartments, which can be individually opened for extracting or dispensing a pill or capsule. The individual compartments are formed by partitions within the container. A top or cover is provided which is initially integral and which provides a plurality of tabs arranged so that an individual tab covers each compartment, the tabs being attached to the cover by a frangible part that can be manually broken free. Each tab is provided with means in the form of a depending rib shaped to snugly fit into the top of its respective compartment to provide an air tight fit. Latching detent means are provided as between the integral cover and the container so that when the cover is positioned it cannot be taken off or removed from the container.

4 Claims, 9 Drawing Figures

51
50
12
66
64
54
14
30
44
29
28
2
10
18
23
15
22
20
24
2
21
27

51
12
72
70
50
51

66
12
70
72
51
64
51
56
50
24
70
22
40
72
14
15
75
44
60
10
18
75
19
23
20

54
27
12
3
50
56
42
44
22
30
58
14
60
34
38
19
22
40
3
23
21
10
36

64
51
66
70
56
50
51
70
12
24
44
75
22
75
72
14
72
20
15
10
18
60
40
19
23

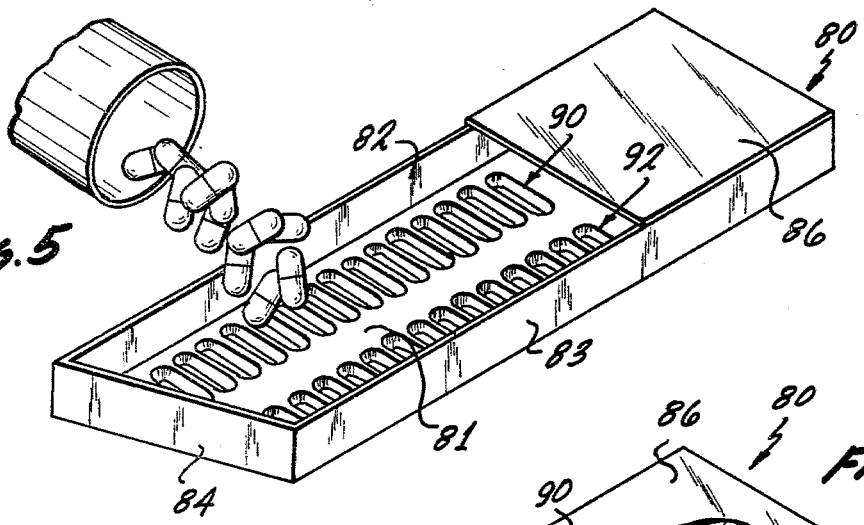
Fig. 5
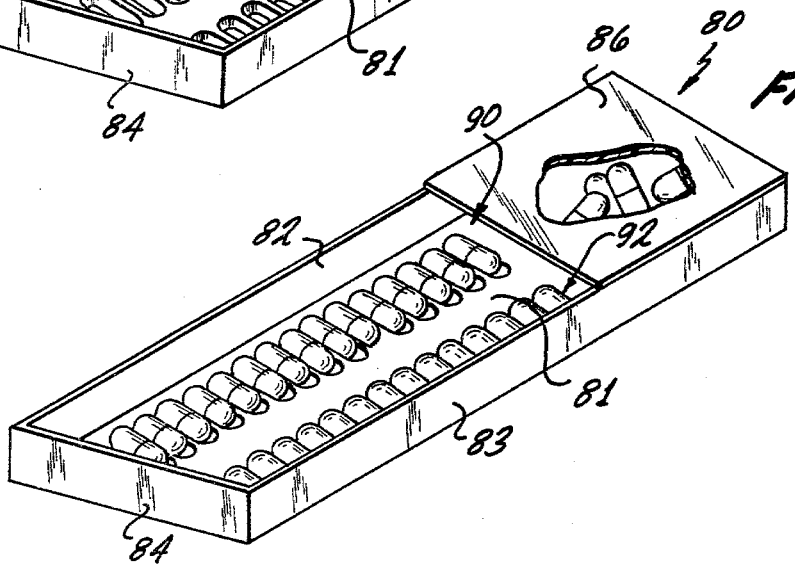
Fig. 6
Fig. 7
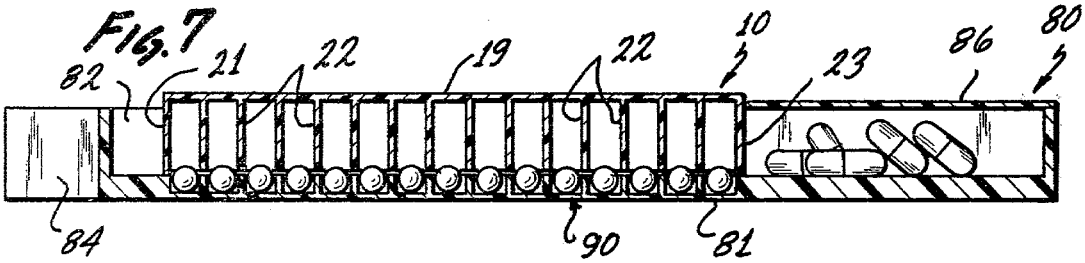
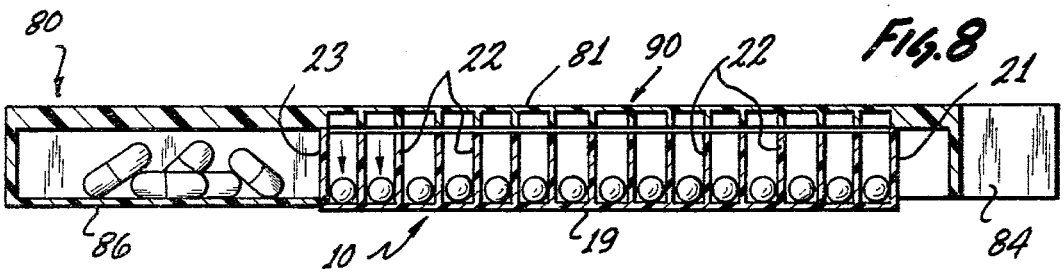
Fig. 8

PLASTIC PILLBOX

BACKGROUND OF THE INVENTION

1. Field of the Invention

The invention is in the field of boxes or containers for pills, capsules, or other medication, wherein multiple compartments are provided that can be individually opened for dispensing or taking out of a pill or medicament.

2. Description of the Prior Art

Reference is made to this inventor's prior U.S. Pat. No. 4,084,695 and to prior U.S. Pat. No. 3,703,955. To the best of the herein inventor's knowledge these prior art patents are more relevant than other known prior art, such as for example, the prior art that was cited against these patents.

The article of U.S. Pat. No. 4,084,695 is a commercially successful item. The prior art however, has left room for improvement in certain respects. In the prior art, individual pill compartments in the container were not air tight, this being a characteristic currently being required in this type of article by the Federal Food and Drug Adminstration.

Further, the characteristic in which there was room for improvement was that in the prior art, the cover for the container was removable as a whole, so that tampering or pilfering was not difficult. An unauthorized person could remove a cover and take out pills or capsules or substitute other pills for more expensive ones originally placed in the container, such as narcotic tablets.

A further area in which there was room for improvement was that it was not readily possible to reclaim a container after use by cleaning and sanitizing it and then reloading it for further use.

A further area in which there has been room for improvement is that of a need for an appliance or tool for facilitating the loading of the pill box or container. Doing so by hand by individually placing pills or capsules in the individual compartments has been a tedious and time consuming process.

The herein invention as described in detail hereinafter provides improvements calculated to fill the needs unfilled by the prior as identified in the foregoing.

SUMMARY OF THE INVENTION

The basic concept of a preferred form of the invention has been summarized in the foregoing abstract, and is described in detail hereinafter.

Preferably the box or container and the integral cover are fabricated by an injection molding process from a suitable plastic material.

Preferably the box or container is fabricated to have intermediate longitudinal partition means and transverse partitions between the longitudinal partition means and the side walls of the container to form the individual compartments. The box is made rigid by way of having two parallel longitudinal partitions with transverse partitions or ribs between the longitudinal partitions.

The top or cover is initially of integral construction. It has a longitudinal spine member to which the individual cover tabs for the compartments are attached by way of a frangible connection or part, such that an individual tab can be broken off and removed to uncover and open its individual compartment. Each tab is provided with means preferably by way of a continuous depending rib which fits into the top of its compartment and seals against the side walls of the compartment to provide an air tight fit. Each tab has an extending lip or part which extends over the top edge of the container so that it can be readily lifted by way of the finger.

The loading appliance or tool is constructed to be adapted for use with the preferred form of the box or container. It is in the form of a rectilinear container an end part of which is preferably covered. In the bottom of the appliance are provided two series of recesses or depressions geometrically related to correspond to the geometric relationship, that is spacing of the two series of compartments in the container. Pills, capsules, or tablets can be dumped into the appliance which then can be agitated to cause the pills to position or align themselves in the depressions in the bottom of the appliance. Then simply by placing the container in an inverted position over the aligned pills the appliance and the container can then be inverted while held together so that the pills or capsules will drop into the compartments in the container thereby simplifying and facilitating the loading operation.

In the light of the foregoing, the primary object of the invention is to make available improvements in a pill box or container of the type described wherein individual compartments can be opened by manually removing a tab having a construction that each individual compartment is air tight. A further object is to realize the foregoing object by way of providing an integral, continuous depending rib on the underside of each tab to interfit with the top of its respective compartment.

A further object is to realize a construction in a box of the type referred to wherein means are provided preferably by way of latching detents whereby the cover when positioned on the container cannot be removed or taken off.

A further object is to realize a container of the type described having the characteristics that after it has been emptied it can be cleaned and sanitized for reuse and can be refilled or reloaded and a new integral cover placed on it.

A further object is to realize a simplified and effective appliance or tool having the capability of being operable to fill or load a pill container by way of easy manipulation.

BRIEF DESCRIPTION OF THE DRAWINGS

FIG. 5 is a pictorial view of a loading appliance for loading the box or container of FIGS. 1–4;

FIG. 6 is a pictorial view similar to FIG. 5 showing pills or capsules positioned in the loading appliance;

FIGS. 7 and 8 are illustrative sectional views illustrating the utilization of the appliance of FIGS. 5 and 6 in loading one of the boxes or container of FIGS. 1–4.

Figure 1:
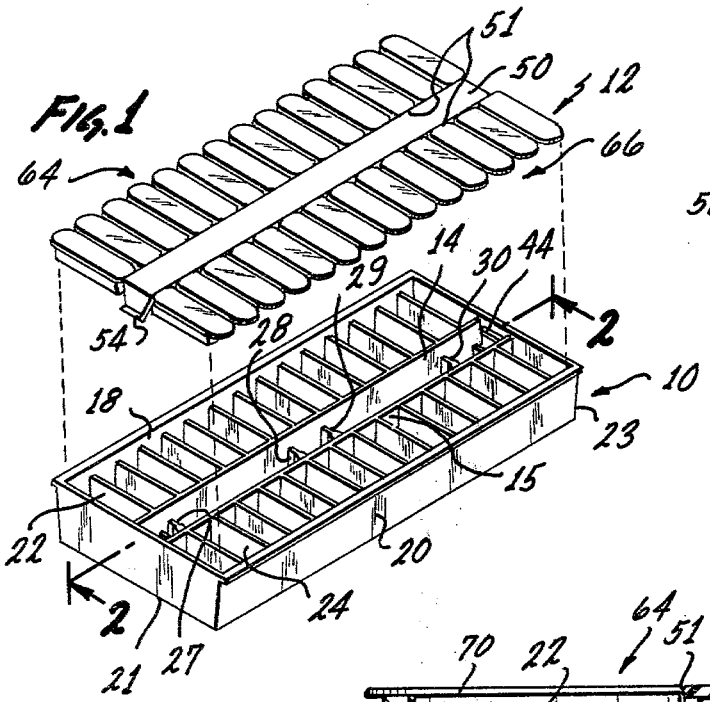
FIG. 1 is an isometric view of a preferred form of the invention.

DESCRIPTION OF THE PREFERRED EMBODIMENT AND BEST MODE OF PRACTICE OF THE INVENTION

Referring to FIGS. 1–4, numeral 10 designates a preferred form of the pill box or container. Preferably it may be fabricated from a suitable type of plastic by a plastic injection molding process. As shown the container is rectilinear having bottom, sides, and ends. Numeral 12 designates an integrally formed cover for the box or container which will be referred to again presently.

Extending longitudinally within the box 10 is a partition means which as shown includes two similar upright partition members as designated at 14 and 15. The side walls of the box are designated at 18 and 20. Extending between the side wall 18 and the partition member 14 are a plurality of equally spaced partitions, one of which is designated at 20. These partitions form individual compartments for pills, capsules, or other medicaments as will be referred to more in detail presently. Extending between the side wall 20 and partition 15 are a plurality of partitions as designated at 24 which are equally spaced and provide another group of individual compartments similar to the other series.

Between the partitions 14 and 15 are a plurality of transverse partitions or ribs as designated at 27, 28, 29 and 30, which are of less depth and which are for the purpose of strenthening and rigidity.

In the bottom wall 19 of the container 10 adjacent to the ends are openings as designated at 34 and 36 and adjacent to these openings are slanting end members or ramps 38 and 40 which are at the end of the space between the partition members 14 and 15. These openings and wall members are present merely to accommodate the fabrication of the container by a plastic injection molding process, the opening accommodating the die used in the molding process.

Extending inwardly from the ends 21 and 23 of the compartment 10 are flanges or detent members 42 and 44 by means of which the top or cover 12 can be latched or secured to the compartment 10 as will be described.

The cover 12 is of unique integral construction. It includes a central longitudinal spine member 50 at the ends of which are depending latch or securement members as designated at 54 and 56 and at the ends of these members are lugs or hooks as designated at 58 and 60. The members 54 and 56 are flexible and the hooks 58 and 60 are able to latch underneath the lugs 42 and 44 to hold the top or cover 12 secured in a position in which it cannot be removed once it has been positioned onto the container 10.

Figure 4A:
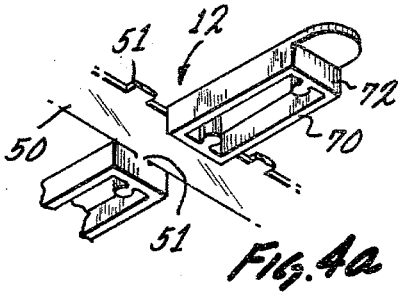
FIG. 4*a* is a detail isometric view of an individual cover tab.

On each side of the spine 50 is a series or plurality of tabs, one series being designated by the numeral 64 and the other by the numeral 66. The tabs are individual, each being of a size to form a top or cover for the individual compartments as identified by the numerals 20 and 24 of the container 10. Each tab is joined to the spine 50 by a frangible joint or connection 21 as seen in detail in FIG. 4*a*. Each tab has an extending lip shown at 25 which when the cover is in position extends outwardly over the side wall of the container 10 so that the tab can be readily lifted by a finger, broken off and disengaged from its compartment. Each individual tab such as the one designated by the numeral 70 has a continuous depending rib on its underside as designated at 72 in FIG. 4, this rib having a size and configuration to fit into its respective compartment with the rib engaging on the inside of the walls of the compartment at the top in order to provide an air tight fit. This is an important feature of the invention as has already been referred to in the foregoing.

As has been explained in the foregoing the box or container is primarily adapted as a box for pills, capsules or medicaments, being constructed so that individual compartments can for example, hold an individual pill or capsule such as the one as identified at 75 in the figures. Individual tabs can be broken off from the cover 12 after it is positioned so that a pill or capsule can be taken out or dispensed one at a time.

A feature of the invention is that when the integral top or cover 12 is positioned after the container has been loaded with pills, the elements 54 and 56 lock in position so that the cover as a whole cannot then be removed preventing tampering with or unloading of the container. This prevents pilfering or substitution of cheap pills for the ones originally loaded which may be expensive narcotic capsules or tablets. The cover provides and effective protective feature.

The pharmacist or supplier of the loaded containers typically may have a contract with a nursing home for example. After all of the tabs have been broken off and the container emptied the box can be sent back to the supplier where it can be cleaned and sanitized or otherwise treated as necessary and then refilled or loaded, and then another integral cover or top can be placed on it and the container reused.

LOADING APPLIANCE

The individual compartments of the container being relatively small as are the pills or capsules, a need exists for an appliance or tool for simplifying the matter of filling or loading the container. A preferred form of such an appliance is illustrated in FIGS. 5–8. As shown it takes the form of a rectilinear container that may be made of plastic or other suitable material as designated by the numeral 80. It has a bottom 81, side walls 82 and 83 and an end wall 84, which is at an angle or slant for purposes as will be described. One end of the container is provided with a top cover as designated by the numeral 86.

Figure 4:
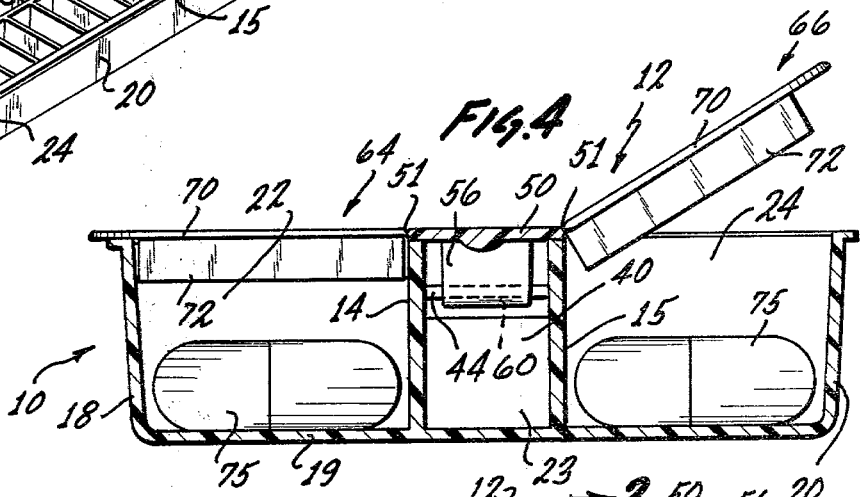
FIG. 4 is a sectional view similar to that of FIG. 3 showing one of the covering tabs being lifted from its compartment.
Figure 2:
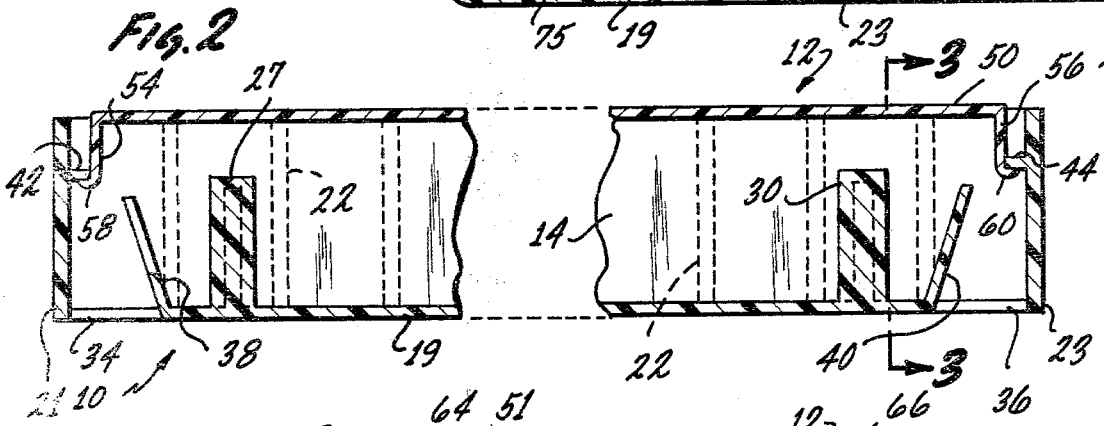
FIG. 2 is a sectional view taken along the line 2—2 of FIG. 1.
Figure 3:
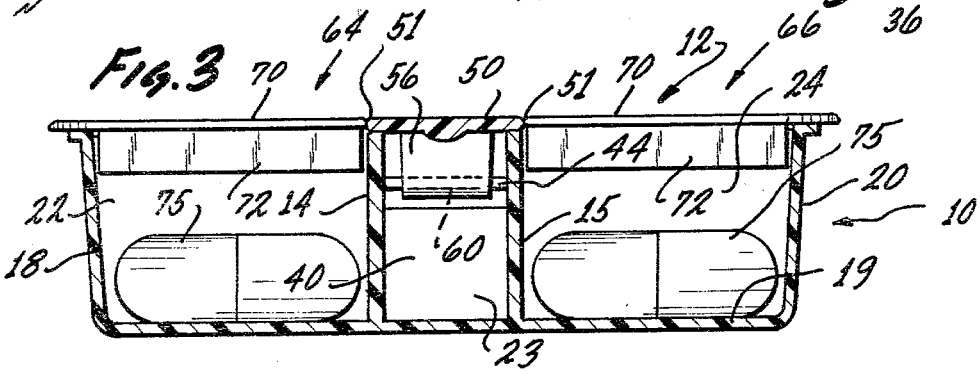
FIG. 3 is a sectional view taken along the line 3—3 of FIG. 2.

Formed in the bottom wall 81 is a first series or plurality of spaced recesses or depressions as designated by the numeral 90, these depressions having the same spacing as the compartments in the container and the recesses or depressions being shaped or configurated to receive individual pills or capsules which may be of a type having a shape as shown at 75 in FIGS. 3 and 4. Numeral 92 designates a second series of spaced recesses or cavities similarly spaced and positioned with respect to the first series to correspond to the two series of compartments in the container 12.

The manner of utilization of the appliance as illustrated in FIGS. 5–8. First a plurality of the pills, tablets, or capsules are dumped into the appliance 80 and may be positioned to cause them to be captured in the end part underneath the partial cover 86. The appliance can then be positioned and agitated so as to cause the pills or capsules to position and adjust themselves in alignment in the two series of recesses 90 and 92 as illustrated in FIG. 6. Then the container 10, before the cover 12 has been put into position is inverted and placed over the appliance 6 as illustrated in FIG. 7 with the individual compartments directly aligned over the two series of recesses 90 and 92 in which the pills or capsules are positioned. Then the container 10 and the appliance 80 while held together are inverted into a position as shown in FIG. 8 in which position the pills or capsules drop from the recesses in which they are held down into the individual compartments in the container 10. Thus as may be seen, by simple operations or manipulations pills or capsules are positioned for loading and then in a simple further manipulation or maneuver the loading of all of the compartments takes place at once. This greatly simplifies and reduces the amount of time and manipulation necessary to load the container. The slanting end 84 operates like a funnel when pouring pills out of the appliance.

From the foregoing those skilled in the art will readily understand and appreciate the nature of the construction of the invention and the manner in which it achieves and realizes the objects as set forth in the foregoing.

The foregoing disclosure is representative of a preferred form of the invention and is intended to be illustrative rather than limiting the invention to be accorded the full scope of the claims appended hereto.

I claim:

1. A multi compartment container for pills and the like, the container being defined by side, end, and bottom walls of material, means defining partitions within the container defining a plurality of individual open top compartments each adapted to receive a product integral generally flat cover means configurated to fit onto the container, and to form a top closure for the individual compartments, said cover including a plurality of individual sections each shaped to provided a closure for an individual compartment and each section including a frangible part connecting it to the cover whereby each individual section can be broken free of the cover in order to open and uncover an individual compartment, the improvement comprising each of said sections and an individual compartment of the said container being mutually configurated whereby each of said sections has the capability of providing an air tight closure for an individual compartment, each of said sections including depending rib means formed on its underside and shaped to snugly fit into the open top of an individual compartment and to engage the side walls thereof to provide the air tight fit.

2. An article as in claim 1 wherein the said container includes intermediate longitudinal partition means, the said cover having a part positioned to overlie the partition means, said frangible part of each of said sections being positioned at an inner end of the section adjacent to the said part of the cover.

3. A multi compartment rectilinear container for pills and alike, the container being defined by side, end, and bottom walls of material, means defining partitions within the container defining a plurality of individual open top compartments each adapted to receive a product, integral cover means configurated to fit onto the container, and to form a top closure for the individual compartments, said cover including a plurality of individual sections each shaped to provide a closure for an individual compartment and each section including a frangible part connecting it to the cover whereby each individual section can be broken free of the cover in order to open and uncover an individual compartment, the improvement comprising securement means whereby the means cover can be placed on the container covering all of the plurality of compartments and secured to the container whereby the integral cover means cannot be moved from the container without breaking it.

4. An article as in claim 3 wherein said securement means include latching members which latch when the integral cover means is placed on the container.

* * * * *